US006974167B2

(12) United States Patent
Springs, II

(10) Patent No.: US 6,974,167 B2
(45) Date of Patent: Dec. 13, 2005

(54) PAN FOR USE WITH ROLLING TRASH RECEPTACLE

(76) Inventor: Wilson B. Springs, II, P.O. Box 246, Myrtle Beach, SC (US) 29578

( * ) Notice: Subject to any disclaimer, the term of this patent is extended or adjusted under 35 U.S.C. 154(b) by 236 days.

(21) Appl. No.: 10/422,242

(22) Filed: Apr. 22, 2003

(65) Prior Publication Data

US 2003/0201650 A1 Oct. 30, 2003

Related U.S. Application Data

(60) Provisional application No. 60/374,982, filed on Apr. 24, 2002.

(51) Int. Cl.[7] ..... A47L 13/52
(52) U.S. Cl. ..... 294/1.1; 15/257.1; 15/257.3
(58) Field of Search ..... 294/1.1, 1.4, 55; 141/108, 390, 391; 15/257.1, 257.3; 248/99–101

(56) References Cited

U.S. PATENT DOCUMENTS 2,305,863 A * 12/1942 Ginter ..... 248/100
3,170,183 A * 2/1965 Leatherman ..... 15/257.1
4,226,456 A 10/1980 Barnett
4,312,531 A * 1/1982 Cross ..... 294/55
4,357,728 A 11/1982 Pravettone
4,442,567 A 4/1984 Pravettone
4,470,627 A 9/1984 Carroll et al.
4,521,043 A 6/1985 Wilsford, deceased
4,550,440 A 10/1985 Rico
4,600,113 A 7/1986 DeMars
4,601,315 A 7/1986 France
4,629,233 A * 12/1986 Pfisterer ..... 294/1.1
4,709,440 A * 12/1987 Conelly ..... 15/257.3
4,749,011 A 6/1988 Rylander
4,795,046 A * 1/1989 Rath ..... 220/694
4,802,258 A 2/1989 Jensen
4,971,274 A * 11/1990 Mitchell ..... 248/101
5,031,948 A * 7/1991 Groth et al. ..... 294/1.1
5,107,666 A 4/1992 Rahtican
5,163,278 A 11/1992 Martenhoff et al.
5,655,739 A 8/1997 Teh-Wah Goo
5,785,369 A 7/1998 Ridley, Sr. et al.
5,878,461 A 3/1999 Killian
6,135,518 A 10/2000 Holthaus
2001/0045371 A1 11/2001 Ordonez

* cited by examiner

*Primary Examiner*—Dean J. Kramer
(74) *Attorney, Agent, or Firm*—Michael A. Mann; Sara A. Centioni; Nexsen Pruet, LLC

(57) ABSTRACT

A pan for use in connection with a trash receptacle with or without a trash bag inserted into the receptacle. The present pan has brackets formed to engage the rim of the receptacle's opening so that debris can be swept directly into the pan and ultimately deposited into the receptacle. Furthermore, the pan elevates the rim of the receptacle so that debris tends to slide toward the bottom of the receptacle. Once the trash receptacle is stood erect, the pan facilitates the moving of all debris easily and quickly into the container or bag.

19 Claims, 3 Drawing Sheets

PAN FOR USE WITH ROLLING TRASH RECEPTACLE

CROSS REFERENCE TO RELATED APPLICATIONS

The present application claims the benefit of priority to U.S. Provisional Application No. 60/374,982 that was filed on Apr. 24, 2002.

STATEMENT REGARDING FEDERALLY SPONSORED RESEARCH OR DEVELOPMENT

Not Applicable.

REFERENCE TO A SEQUENCE LISTING, A TABLE, OR A COMPUTER PROGRAM LISTING COMPACT DISK APPENDIX

Not Applicable.

BACKGROUND OF THE INVENTION

The present invention relates generally to trash collection, and, more particularly, to an improved pan for use in connection with trash receptacles.

Getting yard, workshop debris, and industrial by-product waste into a plastic bag or can for disposal is a problem. This debris includes leaves, bush and hedge trimmings, straw, weeds, bedding materials, sticks, sawdust, wood scraps, plastic dust, trimmings, or other industrial by-product. The effort requires squatting, bending and leaning, which can cause sore back and leg muscles.

Traditional cleanup equipment, such as dustpans and plastic bags, does not work effectively; debris spills from dustpans resulting in frustration. Cleanup is dirty, time-consuming work. Once a plastic bag is filled, it must be moved to another location for disposal. Filed bags are heavy and cumbersome and often, bags will tear or break open.

There are several devices that are intended to facilitate movement of wastes into trash receptacles. In particular, there is the patent issued to Jensen, U.S. Pat. No. 4,802,258, which teaches a modified dustpan that could be used with a cylindrical trash receptacle or used as a regular dustpan. As such, it must fill two quite different, somewhat conflicting requirements and falls short of being ideal for use with a trash receptacle. For example, it has no internal structures that prevent debris, once having been swept into the pan, from sliding out of the top of the container. As another example, the handle makes it more difficult to sweep debris into the container.

Accordingly, there remains a need for an improved device for filling trash receptacles that overcomes the limitations and shortcomings of the prior art trash collecting devices.

SUMMARY OF THE INVENTION

According to its major aspects and briefly recited, the present invention is a pan intended strictly for use in connection with a trash receptacle with or without a trash bag inserted into the receptacle. The present invention is also a combination of the trash receptacle and the pan. The pan is generally shaped like a half-funnel and has a top and bottom surface. On the top surface, the pan includes upstanding side walls. These side walls are inclined so that any debris and trash will tend to fall only within the trash receptacle opening.

On the bottom surface of the pan are included removable brackets. The brackets of the pan have slots that are formed to receive the edge of the opening of a trash receptacle. The orientation of the brackets is such that it will hold the trash receptacle at an angle when the pan engages the ground. This angle assures that receptacle is lifted in such a way that debris tends to slide from the top toward the bottom of the receptacle. Preferably, the leading edge of the pan, which is opposite to the brackets, is angled to facilitate the sliding of the combination of pan and receptacle or the sweeping of debris onto the pan.

A feature of the present pan is its size. It is dimensioned consistent with a large trash receptacle opening so that full size brooms, rather than dust brushes, and leaf rakes can be used to rake or sweep debris into the pan without portions of the debris being swept off the sides of the pan.

Another feature of the present pan is that it is dimensioned to be used on almost any trash container, whether it be oval, round or square, and to help stabilize the trash receptacle. Further, because of its design, the present pan can be used in two ways. First, on a hard surface, the pan can be pushed, pulled or slid until the pan is under the debris then stood up. Alternatively, the pan can be laid in front of the debris pile so that all debris can be raked or swept into the opening of the pan.

Still another feature of the present pan is that it has an internal section to prevent debris, once inside, from sliding out the front of the container. Once the pan is placed on the trash receptacle, a portion of the surface of the pan acts as a barrier to prevent the debris from coming out of the trash receptacle opening.

Yet another feature of the present invention is the use of brackets oriented so that they hold the trash receptacle at a slight upward angle when the pan engages the ground. This angle assures that the debris slides toward and stays at the bottom of the receptacle.

Another feature of the present invention is the use of external, removable brackets designed to hold the pan to a container. These brackets do not interfere with the sweeping of debris into the receptacle. Further, when the pan is not in use, the brackets can be removed for more convenient storage of the pan device.

Other features and advantages of the present invention will be apparent to those skilled in the art from a careful reading of the Detailed Description of the Preferred Embodiments presented below and accompanied by the drawings.

DETAILED DESCRIPTION OF PREFERRED EMBODIMENTS

Figure 1:
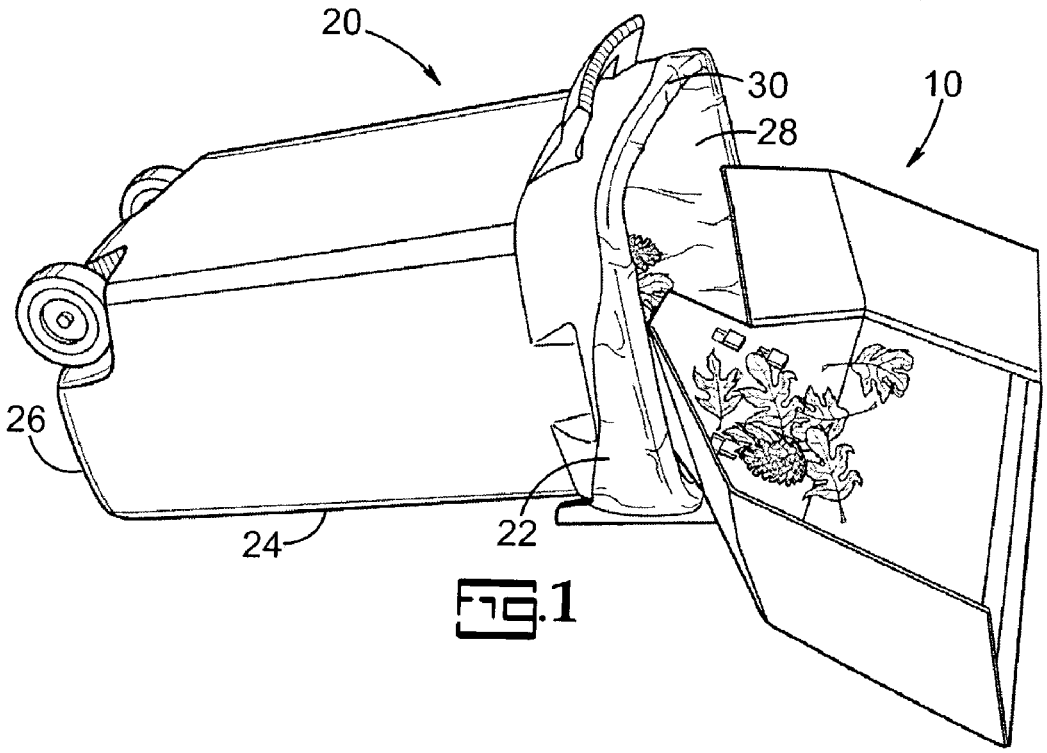
FIG. 1 is a perspective view of the present pan in use with a trash receptacle according to a preferred embodiment of the present invention.

As illustrated in FIG. 1, the present invention is a pan 10 for use with a trash receptacle 20. The present invention is also a combination of trash receptacle 20 with or without a trash bag 22 inserted, and pan 10. For the purpose of these drawings, the trash receptacle 20 is a rolling 45-gallon receptacle. If trash bag 22 is used, a 55-gallon trash bag is preferred with a 45-gallon receptacle. However, other types of trash receptacles 20 having varying dimensions and shapes are contemplated and planned for use and could be used with pan 10 of the present invention. Trash receptacle 20 has a conventional design and includes an annular wall 24, a closed bottom end 26, and a top open end 28 that is defined by an annular rim 30. The pan 10 and trash receptacle 20 cooperate to permit cleanup of a surface or yard with minimal effort and back strain of the user.

Pan 10 of the present invention is shown in detail in FIGS. 2A–6. As illustrated, pan 10 is generally shaped like a half-funnel, and includes a top surface 32, a bottom surface 34, a leading edge 36, and a trailing edge 38. As used herein, "funnel" refers to a utensil used to channel the flow of a substance with a wider and narrower end. On top surface 32 of pan 10 are included upstanding side walls 40. Side walls 40 are inclined and dimensioned to fit within the opening of trash receptacle 20 so that debris can be effectively funneled into top open end 28 of trash receptacle 20 when pan 10 is in use. As shown in FIGS. 2A–4, side walls 40 are spaced farther apart at leading edge 36 of pan 10 than at the trailing edge 38 of pan 10. This orientation allows more effective gathering of debris and prevents spilling of the debris over rim 30 of trash receptacle 20 or over the sides of pan 10.

A feature of the present invention is the size of pan 10. Pan 10 is dimensioned consistent with a large trash receptacle 20 opening so that full size brooms, rather than dust brushes, and leaf rakes can be used to sweep debris into pan 10 without portions of the debris being swept of the sides of pan 10. Preferably, pan 10 is dimensioned to be received by a 45-gallon trash receptacle 20, and has a length (distance between leading edge 36 and trailing edge 38) between 24 to 30 inches and a width (distance between side walls 40) between 30 and 35 inches at leading edge 36 and between 15 and 20 inches at trailing edge 38. Side walls 40 of pan 10 preferably have a height ranging between 5 to 10 inches. Most preferably, pan 10 has a length of 24 inches, a width of 32 inches, and a height of 8 inches. However, depending on the size and shape of the intended trash receptacle, these dimensions can vary. For example, a small version could be fashioned to fit on a bucket or a semi-rounded version could be fashioned to fit a round receptacle.

Figure 2A:
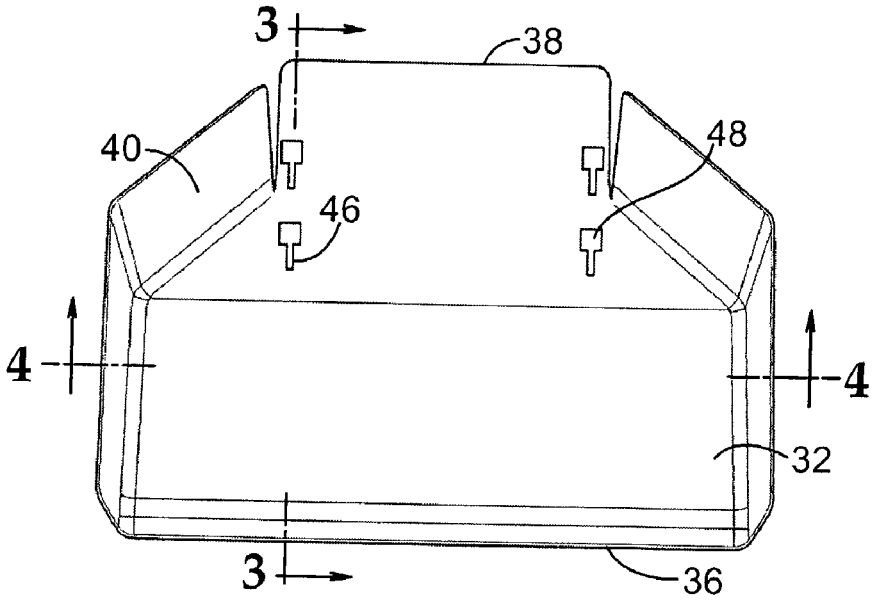
FIG. 2A is a top view of the present pan according to a preferred embodiment of the present invention.

As shown in FIG. 2A, top surface 32 of pan 10 is preferably smooth so that debris and trash are moved easily over pan 10 and into the receptacle 20.

Figure 5:
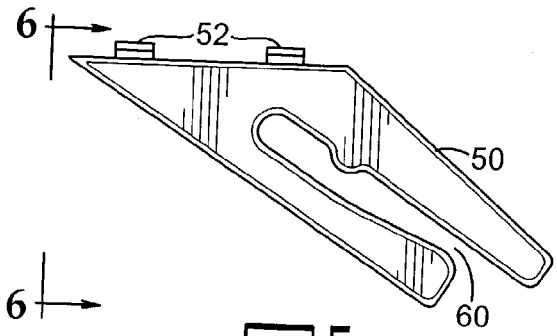
FIG. 5 is a side view of a bracket for use in connection with the present pan according to a preferred embodiment of the present invention.
Figure 6:
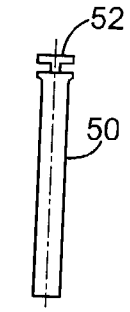
FIG. 6 is a front view of a bracket for use in connection with the present pan according to a preferred embodiment of the present invention.
Figure 7:
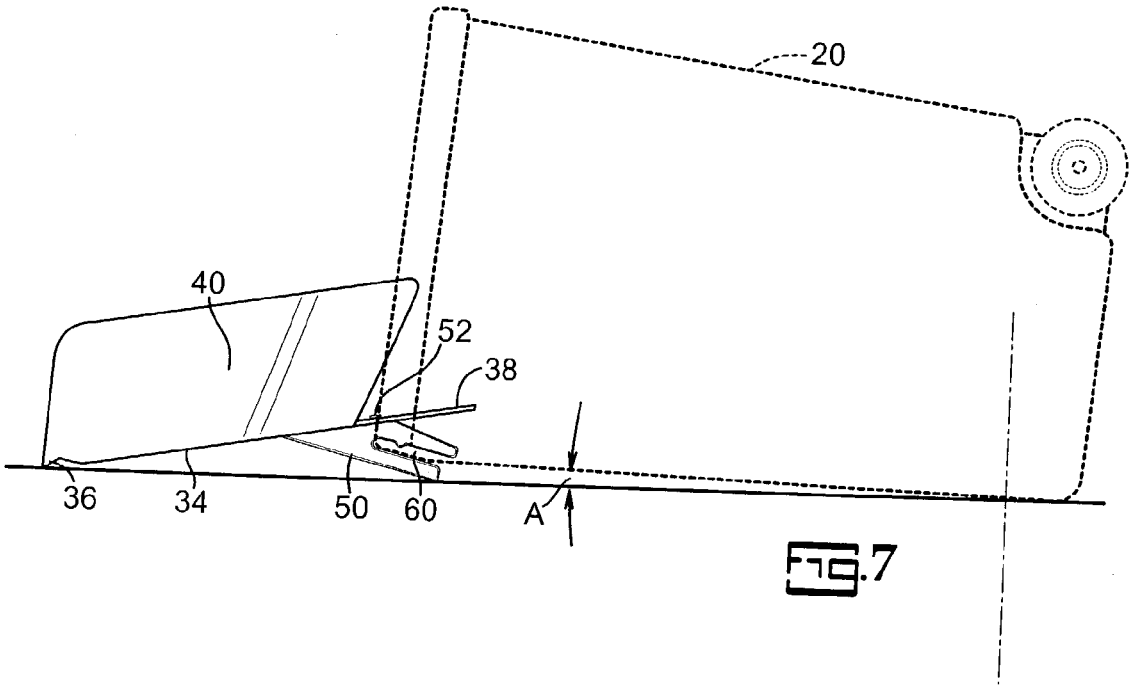
FIG. 7 is a side view of the present pan in combination with a trash receptacle according to a preferred embodiment of the present invention.

Pan 10 of the present invention further includes removable brackets 50, shown in detail in FIGS. 5 and 6, that are attached onto bottom surface 34 of pan 10. As illustrated, brackets 50 include slots 60 that are formed to receive rim 30 of trash receptacle 20 with or without an inserted trash bag 22 in the receptacle 20 and fastened about the top open end 28 of the receptacle 20. The orientation of brackets 50 is such that brackets 50 will hold trash receptacle 20 at a slight angle upward, shown as angle A in FIG. 7, when pan 10 engages the ground. The angle formed, which is preferably equal to or less than 45°, with the rim 30 of the open end 28 of trash receptacle 20 held slightly above the ground, assures that debris swept into the pan 10 and thence into the receptacle 20 will tend to stay inside of the receptacle 20. This angle is determined by the angle with which brackets 50 fit trash receptacle 20, which is preferably approximately 33°. Additionally, trailing edge 38 of pan 10 extends past rim 30 and into trash receptacle 20 when pan 10 and receptacle 20 are engaged (see FIG. 7). Therefore, trailing edge 38 acts as a barrier to further prevent the debris from coming out of the trash receptacle open end 28. Preferably, the leading edge 36 of pan 10 is angled so as to prevent debris from sliding off pan 10 once it has swept or pushed onto pan 10.

Figure 2B:
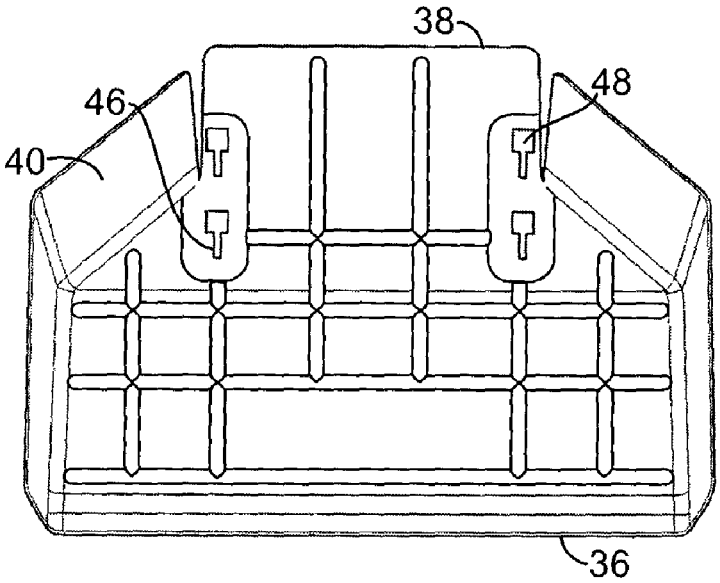
FIG. 2B is a bottom view of the present pan according to a preferred embodiment of the present invention.
Figure 3:
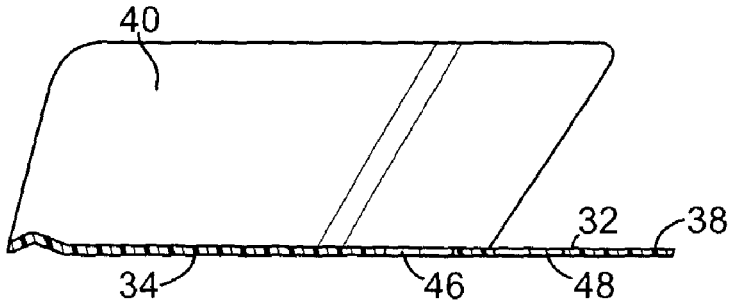
FIG. 3 is a side view of the present pan according to a preferred embodiment of the present invention.
Figure 4:
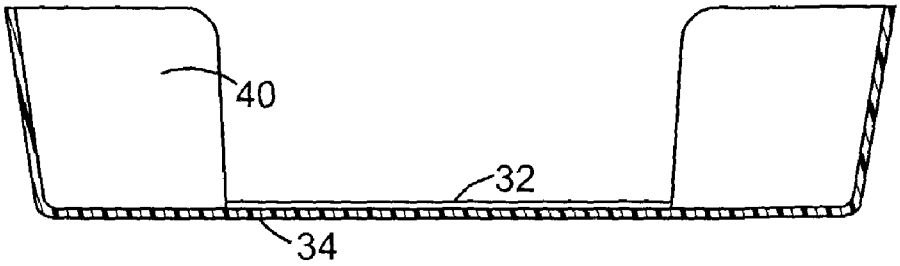
FIG. 4 is a front view of the present pan according to a preferred embodiment of the present invention.

Brackets 50 are made to be removable in order to allow pans 10 to be stacked and otherwise conveniently stored. Preferably, the brackets 50 are made to clip onto pan 10, but can also be fastened to pan 10 by other means for attachment or be made integrally with pan 10. According to the preferred embodiment, brackets 50 include a plurality of male members 52 for use in attaching of brackets 50 to bottom surface 34 of pan 10. As shown in FIGS. 2A and 2B, pan 10 includes a plurality of openings 48 having narrow slits 46 that are dimensioned to receive brackets 50. Brackets 50 are locked into place during use by simply placing male members 52 into openings 48 and sliding male members 52 into slits 46 of openings 48. Alternatively, other means for attachment of brackets 50 may be employed, such as screws. When brackets 50 are removed, they can be taped to top surface 32 or bottom surface 34 of pan 10 so that pan 10 can be stacked for convenient storage shipping, and display.

Preferably, pan 10 is made of a rigid to semi-rigid material, such as a heavy grade plastic, metal or wood. Most preferably, pan 10 is made of an unbreakable plastic that is weatherproof and abrasion-resistant, and is easily manufactured by well-known molding technology.

In use, trash bag 22 may be fitted over rim 30 of trash receptacle 20 with its lid open, if receptacle 20 includes a lid, and the present pan 10 is then engaged with receptacle 20 by fitting rim 30 of receptacle into slots 60 of brackets 50. The receptacle 20 can be carried or wheeled, if receptacle 20 includes wheels, to the desired location and then lowered so that the leading edge 36 of the pan 10 engages the ground. Then, with the rim 30 of the receptacle 20 held in a slightly raised position, the user rakes or sweeps debris into pan 10 and thence into the receptacle 20. Once all sweepings are in the pan 10, the receptacle 20 can be returned to an upright, vertical position. Any debris in pan 10 will fall into the trash receptacle. Giving the receptacle 20 a gentle shake also settles the trash.

To facilitate removal of trash bags 22 from trash receptacle 20, a few holes, preferably 10–15 holes of ½ inch diameter, can be drilled into sides and bottom of receptacle 20 in advance of bag insertion so that air can enter when the bag is pulled out. Then when the receptacle 20 has been rolled to curbside, a user can lower it to the horizontal position and pull the bag from it rather than lift it out of a vertical receptacle.

As previously stated, a feature of the present invention is the use of brackets 50 that hold receptacle 20 at a slight angle when pan 10 engages the ground. This feature is advantageous because it facilitates the retention of debris within receptacle 20. Another feature of the present invention is the use of the combination of pan 10 and receptacle 20 as described herein. This combination greatly reduces the leaning, squatting, and bending associated with yard, industrial or shop cleanup. The combination additionally minimizes spillage, making cleanup more efficient and less disagreeable, and speeds up the overall yard cleanup, because the combination makes it possible to go from pile to pile quickly. Finally, the combination allows bags to be moved in a rolling container to the final location for disposal.

It will be apparent to those skilled in the art of debris collection devices, that many changes and substitutions can be made to the foregoing preferred embodiments without departing from the spirit and scope of the present invention, defined by the appended claims.

What is claimed is:

1. A trash collecting device for use with a trash container having an annular rim, comprising:

a pan having a top surface and a bottom surface, a leading edge and an opposing trailing edge, said top surface including upstanding side walls and said bottom surface carrying brackets between said leading edge and said trailing edge, said brackets having slots formed therein for receiving an annular rim of a trash container so that, when said brackets receive said annular rim of said trash container, said trailing edge extends into said trash container and said leading edge extends out of said trash container.

2. The device as recited in claim 1, wherein said side walls are inclined.

3. The device as recited in claim 1, wherein said pan is dimensioned to be received by said annular rim of a 45-gallon trash receptacle.

4. The device as recited in claim 1, wherein said pan is made of a material selected from the group consisting of heavy grade plastic, wood, metal and any other rigid to semi-rigid material.

5. The device as recited in claim 1, wherein said pan includes openings.

6. The device as recited in claim 5, wherein said brackets include male members that are dimensioned to be received by said openings.

7. A trash collecting device, comprising:

a pan having a top surface and a bottom surface, said top surface including upstanding side walls and said bottom surface including brackets; and a trash receptacle having an annular rim, said brackets being adapted for receiving said annular rim, and wherein said brackets are orientated so that, when said annular rim is received by said brackets and said pan engages the ground, said trash receptacle is held at a slight upward angle so that debris in said trash receptacle tends to slide deeper into said trash receptacle.

8. The device as recited in claim 7, wherein said brackets include slots for receiving said annular rim.

9. The device as recited in claim 7, wherein said pan has a trailing edge, and wherein said brackets are carried by said annular rim so that said trailing edge extends past said annular rim and into said trash receptacle.

10. The device as recited in claim 7, wherein said angle is less than or equal to 45°.

11. The device as recited in claim 7, wherein said side walls are inclined.

12. The device as recited in claim 7, wherein said pan has a leading edge, said leading edge being angled.

13. The device as recited in claim 7, wherein said pan includes openings having slits.

14. The device as recited in claim 13, wherein said brackets include male members that are dimensioned to be received by said openings.

15. The device as recited in claim 14, wherein said male members are dimensioned to be locked by said slits.

16. A device for use with a trash container having an annular rim, said device comprising:

a pan having an upper surface and a lower surface, a leading edge and an opposing trailing edge; and at least one bracket carried by said lower surface of said pan between said leading edge and said trailing edge, said at least one bracket having means formed therein for receiving an annular rim of a trash container and adapted to hold said trash container at an upward angle when said pan engages the ground so that debris, swept onto said upper surface of said pan and into said trash container tends to fall into said trash container and away from said annular rim.

17. The device as recited in claim 16, wherein said at least one bracket is carried by said lower surface so that said trailing edge extends into said trash container past said annular rim.

18. The device as recited in claim 16, wherein said upward angle is less than 45°.

19. The device as recite in claim 16, wherein said pan has upstanding side walls.

* * * * *